US010514038B2

(12) United States Patent
Jensen et al.

(10) Patent No.: US 10,514,038 B2
(45) Date of Patent: Dec. 24, 2019

(54) PUMP ASSEMBLY

(71) Applicant: Grundfos Holding A/S, Bjerringbro (DK)

(72) Inventors: Olav Jensen, Viborg (DK); Ole Hansen, Bjerringbro (DK); Bent Døssing, Silkeborg (DK); Robert Greve, Randers NV (DK)

(73) Assignee: Grundfos Holding A/S, Bjerringbro (DK)

( * ) Notice: Subject to any disclaimer, the term of this patent is extended or adjusted under 35 U.S.C. 154(b) by 211 days.

(21) Appl. No.: 15/645,036

(22) Filed: Jul. 10, 2017

(65) Prior Publication Data

US 2018/0010609 A1 Jan. 11, 2018

(30) Foreign Application Priority Data

Jul. 8, 2016 (EP) ..... 16178585

(51) Int. Cl.
*F04D 15/00* (2006.01)
*F24D 3/10* (2006.01)
(Continued)

(52) U.S. Cl.
CPC ..... *F04D 15/0016* (2013.01); *F04D 13/06* (2013.01); *F04D 13/0606* (2013.01); *F04D 29/086* (2013.01); *F04D 29/22* (2013.01); *F04D 29/2283* (2013.01); *F04D 29/4293* (2013.01); *F04D 29/486* (2013.01); *F24D 3/105* (2013.01);
(Continued)

(58) Field of Classification Search
CPC .. F04D 15/0005; F04D 15/0016; F04D 29/48; F04D 29/483; F04D 29/486; Y10S 415/911; F24D 3/105
See application file for complete search history.

(56) References Cited

U.S. PATENT DOCUMENTS 1,680,775 A * 8/1928 Faber ..... F04D 29/483 123/41 R
4,000,235 A * 12/1976 Van Leemput ..... B22F 3/04 264/109
(Continued)

FOREIGN PATENT DOCUMENTS

CN 1185558 A 6/1998
CN 104343546 A 2/2015
(Continued)

*Primary Examiner* — Peter J Bertheaud
(74) *Attorney, Agent, or Firm* — McGlew and Tuttle, P.C.

(57) ABSTRACT

A pump assembly includes pump casing (2), an impeller (14) rotatably arranged in the pump casing, a two rotation directions (A, B) electrical drive motor connected to drive the impeller and a valve arrangement (28) arranged in the pump casing to switch a flow path downstream of the impeller between two exits (24, 26) of the pump casing, depending on a rotation direction of the impeller. The valve arrangement includes a first movable valve element (34) at a first exit (24) and a second movable valve element (36) at a second exit (26). The first valve element partly closes the first exit in a closed position and is movable into an opened position by flow in the first rotation direction and the second valve element partly closes the second exit in a closed position and is movable into an opened position by flow in the second rotation direction (B).

13 Claims, 12 Drawing Sheets

(51) Int. Cl.

| | |
|---|---|
| ***F04D 29/48*** | (2006.01) |
| ***F04D 13/06*** | (2006.01) |
| ***F04D 29/08*** | (2006.01) |
| ***F04D 29/22*** | (2006.01) |
| ***F04D 29/42*** | (2006.01) |

(52) U.S. Cl.
CPC ..... *F05D 2250/52* (2013.01); *Y10S 415/911* (2013.01)

(56) References Cited

U.S. PATENT DOCUMENTS 4,838,488 A * 6/1989 Heier ..... F04D 15/0016 137/594
4,846,260 A * 7/1989 Maas ..... F04D 29/483 165/47
4,874,298 A * 10/1989 Mainardi ..... F04D 15/0016 417/315
5,344,293 A * 9/1994 Mota ..... F04D 15/0016 137/119.03
5,586,862 A * 12/1996 Danner ..... F04D 15/0016 415/146
5,934,872 A * 8/1999 Yamauchi ..... F04D 15/0016 415/146
9,261,086 B2 * 2/2016 Takai ..... F04D 15/0016
9,612,036 B2 * 4/2017 Hannibalsen ..... F24D 3/08
2011/0308767 A1 * 12/2011 Hannibalsen ..... F24D 3/08 165/67
2015/0034192 A1 2/2015 Hossfeld et al.

FOREIGN PATENT DOCUMENTS

| | | | |
|---|---|---|---|
| CN | 104344032 | A | 2/2015 |
| DE | 34 42 907 | A1 | 6/1986 |
| DE | 197 45 737 | A1 | 5/1998 |
| DE | 10 2007 052490 | A1 | 5/2009 |
| JP | 3338297 | B2 | 10/2002 |

* cited by examiner

PUMP ASSEMBLY

CROSS REFERENCE TO RELATED APPLICATIONS

This application claims the benefit of priority under 35 U.S.C. § 119 of European Application 16 178 585.2 filed Jul. 8, 2016, the entire contents of which are incorporated herein by reference.

FIELD OF THE INVENTION

The invention relates to a pump assembly with a pump casing, with an impeller which is rotatably arranged in the pump casing, with an electrical drive motor which is connected to the impeller for the drive of the impeller and which is selectively driveable in two rotation directions, as well as with a valve arrangement which is arranged in the pump casing and is designed to switch a flow path downstream of the impeller between two exits formed in the pump casing, in a manner depending on the rotation direction of the impeller.

BACKGROUND OF THE INVENTION

The problem of switching the heating water circuit between two flow paths, specifically once through a heating circuit in the building and once through a heat exchanger for heating service water, arises in heating facilities, in particular compact heating facilities. For this, it is known to apply pump assemblies with integrated valve elements which switch between two possible flow paths, in dependence on the rotation direction of the impeller of the pump assembly. As a rule, a movable valve element is provided for this, and this valve element is carried along by the flow around the impeller, and, depending on the flow direction, is pressed against one of two possible exits, in order to close these, so that the flow leaves through the respective other exit of the pump assembly. This means that the valve element closes the exits in an alternating manner such that one exit is always closed and the other exit is simultaneously opened. Water hammers which lead to undesirable noises in the system are a problem with such designs.

SUMMARY OF THE INVENTION

With regard to this problem, it is an object of the invention, to improve a pump assembly with a valve element capable of being switched over due to the rotation direction of the drive motor, to the extent that an as quite as possible switching of the valve element is possible.

This object is achieved by a pump assembly with the features according to the invention. Preferred embodiments are to be deduced from this disclosure including the following description as well as the attached figures.

The pump assembly according to the invention comprises a pump casing, in which an impeller is rotatably arranged. The impeller thereby rotates in the interior of the pump casing. The impeller is connected to a suction connection or suction branch in the known manner. The pump assembly moreover comprises an electrical drive motor, whose rotor is connected to the impeller in a rotationally fixed manner, in a manner such that the electrical drive motor can drive the impeller in rotation. The drive motor or its stator housing is preferably connected to the pump casing in the known manner.

The drive motor is configured such that it can be selectively driven in two rotation directions in a targeted manner. A suitable control device can be provided for this, wherein this activates the drive motor such that it rotates in a desired rotation direction. For this, the control device preferably controls the current-subjection of the stator coils of the drive motor. The control device in particular can comprise a frequency converter, via which, apart from the rotation direction, the rotational speed of the drive motor can preferably also be closed-loop controlled. The impeller also therefore selectively rotates in two desired opposite rotation directions, depending on the rotation direction of the drive motor.

A valve arrangement is also arranged in the pump casing, and this arrangement can switch an exit-side flow path, which is to say the flow path downstream of the impeller, between two exits formed in the pump casing. One of the exits for example can be provided for a heating circuit through the building, and the other exit for a secondary heat exchanger for heating the service water, in the case of the use of the pump assembly in a heating facility. The valve arrangement is preferably configured such that it can be moved by the flow created by the impeller, between two switch positions, wherein the flow in the peripheral region of the impeller is likewise directed in different directions, depending on the rotation direction of the impeller. A valve element of the valve arrangement can be moved in a targeted manner between several switch positions due to the different flow directions.

According to the invention, the valve arrangement comprises two valve elements, wherein a first movable valve element is arranged at a first of the two exits, and a second movable valve element at a second of the two exits. The first valve element therefore serves for closing the first exit, whilst the second valve element serves for closing the second exit. The valve elements are arranged and configured such that in an idle position, which is to say when the impeller is at a standstill, they are situated in their closed position. This means that in the idle position, the first valve element at least partly closes the first exit, and the second valve element at least partly closes the second exit. A partial closure of the exits in the context of this invention is to be understood in that the exit in the closed position, in its cross section is reduced in size compared to the opened position, preferably by more than half, further preferably by more than two thirds. As explained below, a certain flow passage preferably also remains in the closed position.

The valve elements are moreover arranged and configured such that the first valve element can be moved by a flow created by the impeller in its first rotation direction, into an opened position, whilst the second valve element is movable into an opened position by way of a flow created by the impeller in its second rotation direction. If the first valve element is moved into its opened position by the flow, then the second valve element simultaneously remains in its closed position. Conversely, the first element remains in its closed position when the second valve element is moved into its opened position by the flow which occurs on rotation of the impeller in the second rotation direction.

The design according to the invention, compared to the known switching devices which are dependent on the rotating direction, has the advantage that the exits are essentially closed in the idle position. This has the effect that a flow is firstly produced essentially only in the inside of the pump casing on starting operation of the pump assembly, in order to move one of the valve elements into its opened position in a manner depending on the rotation direction. Water hammers due to switching on starting operation of the pump assembly are minimized or avoided due to the fact that essentially no flow through the exits is effected. This means that a flow whose hydraulic energy is used for moving one of the valve elements is firstly produced in the inside of the pump assembly, on starting operation of the pump assembly.

On starting operation of the pump assembly, one valve element always opens, which is to say one of the valve elements is moved into its opened position, in a manner depending on the rotation direction. The valve element moves back again into its closed position when the pump assembly is switched off, which is to say the impeller comes to a standstill. The drive motor is then driven in the opposite direction for switching over the valve device, so that the impeller in the inside of the pump casing produces a flow in the opposite direction, and this flow opens the other valve element and thus leads the flow through the other exit to the outside out of the pump assembly.

The design and configuration according to the invention, on account of the targeted activation of the drive motor, which is to say in particular not only due to the selection of the rotation direction, but also of the course of the acceleration, permits a very gentle and quiet switching between the two flow paths which are defined by the two exits.

The first and the second valve element are preferably movable independently of one another. This permits the first valve element to remain in its closed position, whilst the second valve element moves into its opened position, and vice versa.

The first and the second valve element are moreover preferably each configured as a flap which is pivotable about a pivot axis between the opened position and the closed position. The flap thereby preferably with one surface comes to sealingly bear on a valve seat surrounding an associated exit. The valve elements are preferably arranged such that their pivot axis is situated at a longitudinal end, wherein this longitudinal end is preferably that longitudinal end which is situated furthest to the impeller. The pivot axis or pivot axes of the flaps further preferably extend parallel to the rotation axis of the impeller, wherein the flaps extend essentially radially to the impeller.

The valve elements further preferably comprise a sealing region or a sealing surface which can come into sealing contact with a corresponding valve seat surrounding the associated exit. The valve elements additionally preferably comprise an engagement surface or an engagement region, upon which the flow for moving the valve element and produced by the impeller acts. If the valve element is configured as a flap, as is described above, then the engagement region is preferably formed by an axial end region of the flap which is distanced to the pivot axis. The engagement region preferably extends into an annular space of the pump casing which surrounds the impeller, so that the flow in this annular space and produced by the impeller can act directly upon the engagement region.

According to a further preferred embodiment, the first and the second valve element are pivotable about the same pivot axis. This, as described above, can be a pivot axis which preferably extends parallel to the rotation axis of the impeller. Thereby, the valve elements are preferably configured in a flap-like manner in the previously described manner, wherein the flaps are articulated with one end on the pivot, and the opposite free end of the flaps in each case forms an engagement surface or an engagement region for the flow. The sealing region or the sealing surface preferably lies between the engagement region and the pivot axis. The pivot axis is thereby preferably arranged on the end of the flap which is distanced furthest to the impeller.

Further preferably, the valve elements are configured and arranged such that when one of the valve elements is situated in its opened position, they are in contact with one another. This means that the valve element moving into the opened position preferably pivots so far, until it comes into contact on the other valve element dwelling in its closed position. This design has the advantage that the released flow path to the opened exit is maximized and the opened valve element additionally presses the valve element located in its closed position, into its closed position and/or can assume and additional sealing function, as will be described hereinafter.

According to a preferred embodiment of the invention, the valve elements each comprise an opening which permits a flow passage into the associated exit, also in a closed position of this valve element. This means that the opening extends into the exit, from that side of the valve element which faces the interior of the pump casing, i.e. which is directed to the impeller. These openings in the valve elements are preferably dimensioned such that in the closed positions of the valve elements, the exits are essentially closed, which is to say closed for the greater part, as described above, but a small flow passage however remains. The opening essentially ensures that a pressure compensation between both sides of the valve element is given. This pressure compensation ensures that the valve element is not pressed against the valve seat by the pressure produced in the pump casing, on starting up the impeller. The holding force which is to be overcome by the flow is reduced by way of this, so that the valve element can be moved more easily from the closed into the opened position. This assists a quiet, gentle switching of the valve device by way of moving one of the valve elements.

The opening in the first valve element and the opening in the second valve element are preferably arranged offset to one another in a manner such that the opening in the first valve element is closed by the second valve element, and the opening in the second valve element is closed by the first valve element, when the two valve elements are in contact with one another. This means that the valve element situated in its opened position closes due to it coming to bear on the other valve element which is in its closed position, and the opening being simultaneously located in that valve element which is located in its closed position. It is only with the opening of one of the valve elements that the other valve element, and by way of this, the associated exit are completely closed. The pressure produced by the pump assembly then acts upon both valve elements in this condition, so that these valve elements are pressed against one another and the valve element which is located in its closed position, is pressed against the associated valve seat. In this condition, the associated exit in this condition is then completely closed by the valve element which is located in its closed position. This means that one succeeds in the valve elements essentially not being subjected to pressure, in the idle position and on starting up the pump assembly, when the two valve elements are located in their closed position, due to the openings being arranged in such a manner. If however one of the valve elements is in its opened position, the other element located in its closed position is subjected to the pressure produced by the impeller and held in the closed position.

Further preferably, the first and the second valve element are impinged by force by way of at least one restoring element, in a manner such that they are each held in their closed position given a standstill of the impeller, wherein preferably the first and the second valve element are subjected to force by way of a common restoring element, in particular by way of a spring arranged between the valve elements. The restoring element or elements therefore ensure that the valve elements are moved back again into their idle position, which is to say their closed position, after switching off the pump assembly, when the impeller comes to a standstill. If a common spring element is present, then the spring element can particularly preferably be configured as a rotary spring which rotates about a common rotation or pivot axis of the two valve element and with its free limbs is engaged or in contact with one of the valve elements in each case. This permits a particularly simple construction and a simple assembly, since the rotary spring together with the two valve elements can be pushed onto a common pivot or rotation pivot.

The valve elements can be configured elastically or rigidly. If the valve elements are configured elastically, then in the simplest case they can be configured as tabs or flaps of a rubber material or elastomer material. The elastic restoring forces are produced with the deformation of the valve element forming the described restoring element, if the valve elements are configured in an elastic manner. Such valve elements can be moved from the closed into the opened position by way of the deformation. If the valve elements are configured in a rigid manner, they preferably rotate about stationary pivot or rotation pivots (axes), in particular about a common pivot or rotation axis. The rigid valve elements are configured in an essentially rigid manner, but however can additionally have elastic regions or sections which particularly preferably can be materially connected to the rigid sections. The rigid valve elements e.g. can be additionally provided with elastic sealing surfaces or elastic sections.

An elastic seal is preferably arranged in each case on the valve elements and/or valve seats lying opposite these. This ensures a reliable sealing of the exit when the valve element is in its closed position. An elastic seal can be additionally provided between the two valves elements if these comprise openings in the manner described above. Such an additional sealing element ensures a sealing in the region of the opening of that valve element which is located in its closed position, when the second valve element comes to bear on this. The opening in the valve element can thus be surrounded by an elastic seal, at the side of the valve element which faces the second valve element. Alternatively or additionally, a sealing surface can be formed on the valve elements, in a region covering the opening of the other valve element, when the two valve elements come into contact with one another.

According to a particular embodiment of the invention, the pump casing comprises a receiving opening which is situated between the two exits and which is open towards the interior of the pump casing and into which the two valve elements are inserted from the outer side of the pump casing, wherein the two valve elements are preferably mounted in a valve insert which is inserted into the receiving opening. The receiving opening is sealingly closed to the outside by a cover, wherein this cover is preferably part of the valve insert. The assembly is simplified by way of this, since the valve elements can be inserted from the outside into the pump casing. The valve elements are moreover easily accessible for maintenance purposes, without having to disassemble the remaining parts of the pump assembly. The receiving opening is preferably shaped such that seen from the outside, it has no undercuts. The pump casing with the receiving opening can thereby be easily manufactured as a molded part, in particular as an injection molded part of plastic, wherein a core which defines the receiving opening, can be pulled out of the pump casing to the outside. One can therefore make do without a lost core.

The described two exits of the pump casing are preferably situated in the receiving opening or branch from the receiving opening. This means the flow, departing from the interior of the pump casing, in which interior the impeller rotates, firstly exits into the receiving opening and then from there into one of the two exits, depending on which valve element is situated in its opened position.

According to a further preferred embodiment of the invention, the two exits each comprise a valve seat which faces the interior of the pump casing which is to say is situated in the flow path from the interior, and on which the associated valve element comes to bear with a sealing surface in its closed position, in order to at least partly close the respective exit. The valve seats of the two exits preferably lie opposite one another, wherein the valve seats particularly preferably extend essentially parallel to one another. If the valve seats are situated in the receiving opening, then the valve seats preferably extend essentially parallel to the longitudinal direction of the receiving opening on two side walls of the receiving opening which lie opposite one another. An essentially parallel arrangement of the valve seats means that slight mold removal slants which are necessary, in order to remove a core out of the receiving opening after the molding, can still be considered as a parallel arrangement in this context. The opposite arrangement of the valve seats permits that valve element which moves into its opened position, to be able to move to the second valve element situated in a closed position, and to be able to come into contact with this valve element, as described above. This is particularly the case if the valve elements undergo a pivoting movement from the closed into the opened position. If the valve elements are arranged in such a pivotable manner, then the pivot axes preferably extend parallel to the surfaces which are spanned by the valve seats. In the case of a common pivot axis, this is preferably situated in a plane which is situated between the surfaces spanned by the valve seats.

The valve elements further preferably each comprise a sealing surface which is provided for contact on a valve seat and which extends in an angled manner to a radius with respect to the pivot axis of the respective valve element. Such valve elements in a plane normal to the pivot axis preferably have an essentially triangular shape, wherein one side of the sealing element which forms the sealing surface, and a second side of the valve element which is provided for contact on the second valve element, preferably extend at an acute angle to one another. The pivot axis or rotation axis thereby preferably lies on or in the surface which is provided for contact with the second valve element. The angled arrangement of the sealing surface permits the valve seats to be able to be situated in planes extending parallel to one another, despite the envisaged pivoting given a common pivot axis.

The pump assembly is particularly preferably configured as a circulation pump assembly and further preferably as a heating circulation pump assembly. In particular, it can be the case of a heating circulation pump assembly which is applied in a gas heater. Inasmuch as this is concerned, a gas heater with a pump assembly as described beforehand and hereinafter, is also the subject matter of the invention and of this patent application. Thereby, the pump assembly can be part of a hydraulic block which forms an integrated construction unit for a compact heating facility and in particular for a gas heater.

The drive motor is preferably a wet-running drive motor which is to say a drive motor with which the rotor and stator are separated from one another by a can or canned pot which is to say air-gap sleeve. The drive motor particularly preferably comprises a permanent magnet rotor. The drive motor can further preferably comprise a frequency converter for speed regulation.

According to a further preferred embodiment of the invention, the impeller and the interior of the pump casing can be dimensioned in a manner such that an annular free space remains in the peripheral region of the impeller in the inside of the pump casing. This annular free space preferably has a size, with which the radius of the inner periphery of the pump casing, at least in a peripheral section in the peripheral region of the impeller, is at least 1.4 times and preferably at least 2 times as large as the radius of the impeller. Particularly preferably, the radius of the inner periphery of the pump casing is dimensioned accordingly over the complete periphery. Further preferably, the radius of the inner periphery of the pump casing in at least a peripheral section is at least 2 or 3 times as large as the radius of the impeller. The formation of a peripheral, rotating flow which runs in a manner depending on the rotation direction of the impeller and can thus move the valve elements into the desired switch position is assisted by this annular free space which surrounds the impeller. The valve elements are preferably arranged and dimensioned such that a free space between the valve element and the outer periphery of the impeller remains in each position, so that the circulating flow is not prevented by the valve element.

The invention is hereinafter described by way of example and by way of the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
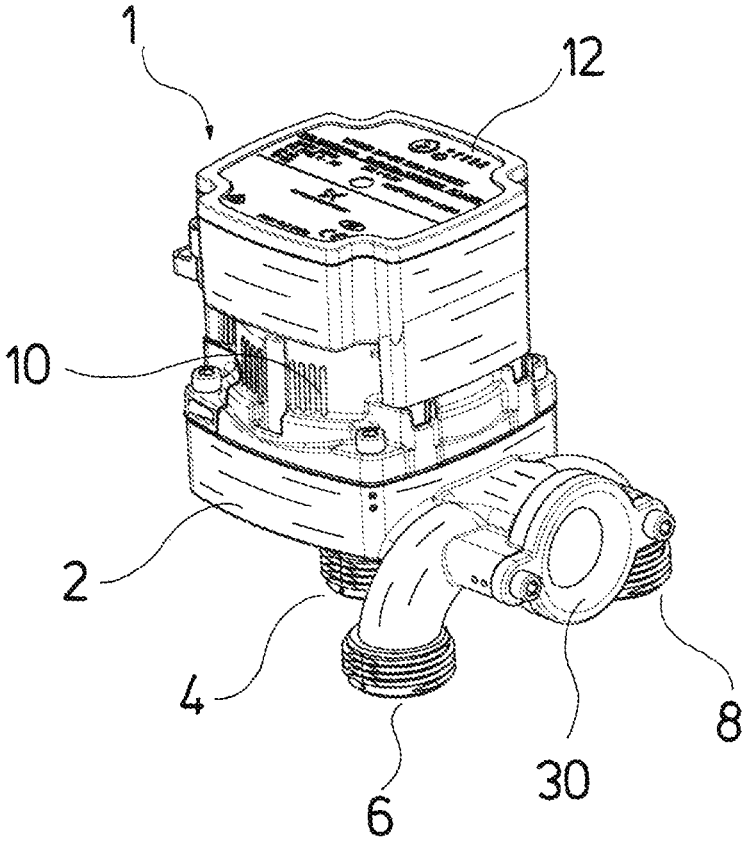
FIG. 1 is a perspective total view of a pump assembly according to the invention.

Referring to the drawings, the pump assembly 1, which is represented in the figures, is configured as a circulation pump assembly with a wet-running electrical drive motor. The pump assembly 1 comprises a pump casing 2 which can be configured as a molded component of metal or plastic. The pump casing 2 comprises a suction connection 4 and two delivery branches 6 and 8. A motor or stator casing 10, in which the electrical drive motor is arranged, is applied onto the pump casing 2. An electronics housing 12, in which a control and regulation device for the control of the electrical drive motor is arranged, is arranged on the axial end of the stator casing 10 which is away from the pump casing 2.

Figure 2:
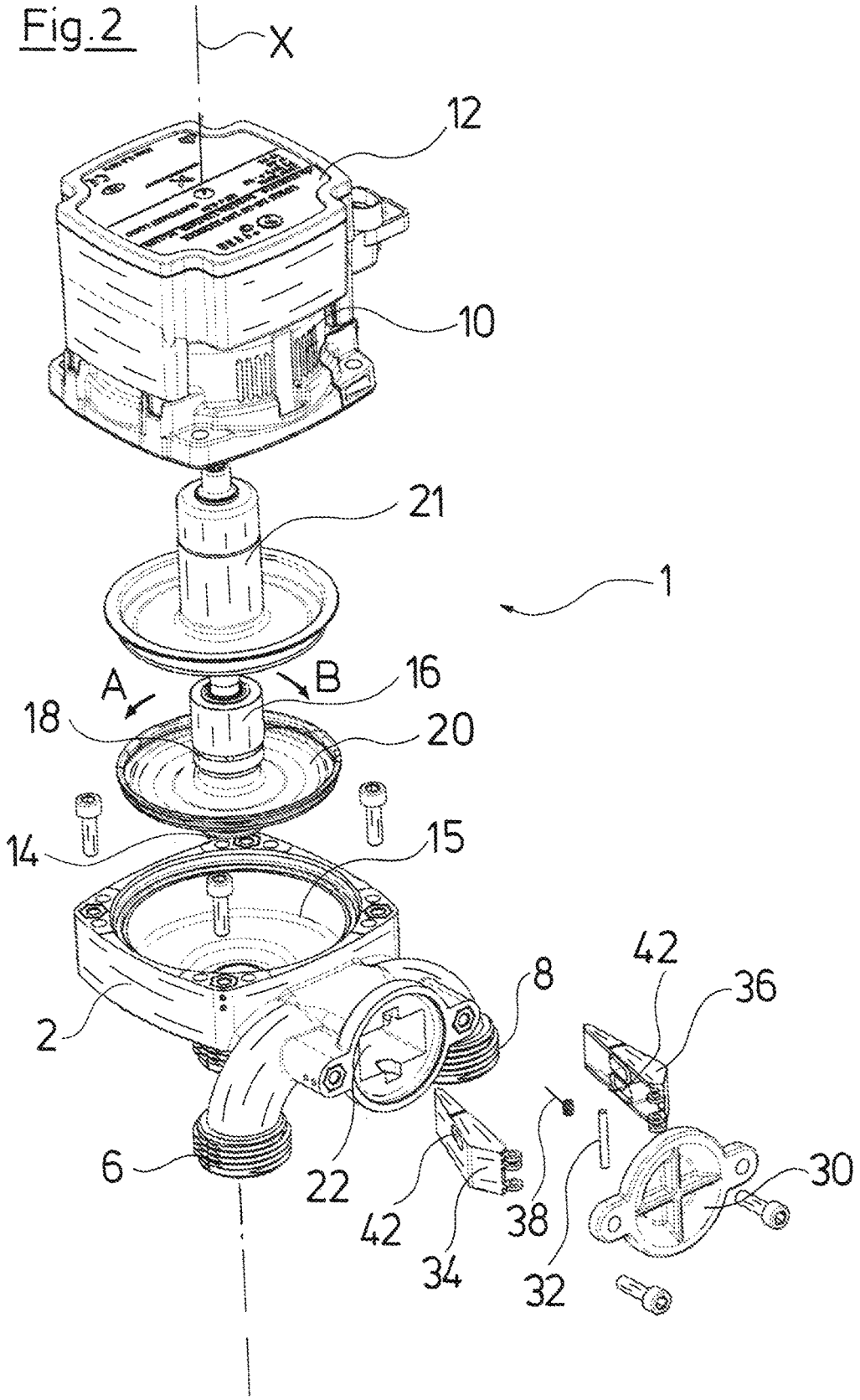
FIG. 2 is an exploded view of the pump assembly according to FIG. 1.

As can be recognized in the exploded view according to FIG. 2, an impeller 14 which is connected to the rotor 16 of the electrical drive motor in a rotationally fixed manner is arranged in the inside of the pump casing 2. The rotor 16 is rotatably held in a bearing 18, which is fixed on a bearing plate 20 in the pump casing 2. The stator of the electrical drive motor is arranged in the inside of the stator casing 10, and a canned pot 21 which separates the rotor space in which the rotor 16 is arranged, from the stator, so that the rotor space can be filled with fluid, is situated on the inner periphery of this stator. It is therefore the case of a wet-running drive motor.

A receiving opening 22 extends radially outwards, departing from the interior 15 of the pump casing 2, in which the impeller 14 rotates. The receiving opening 22 forms part of an exit-side flow path, through which the flow accelerated by the impeller 14 exits out of the pump casing 2. Thus two delivery branches 6 and 8 branch at a first exit 24 and a second exit 26 which are is situated in the inside of the receiver opening 22 (see FIG. 7).

A valve insert 28 which comprises a closure plate 30 closing the receiving opening 22 to the outside, is inserted into the receiving opening 22 from the outside. The closure plate 30 simultaneously serves as a carrier and holds a rotation pivot or simply pivot 32, on which a first valve element 34 and a second valve element 36 are pivotably mounted. A rotary spring 38 which forms a restoring element and in the assembled condition presses the first valve element 34 and the second valve element 36 apart, is moreover arranged on the pivot axis 32. The two valve elements 34 and 36 are configured identically and are merely arranged in a manner rotated to one another by 180.

Figure 3:
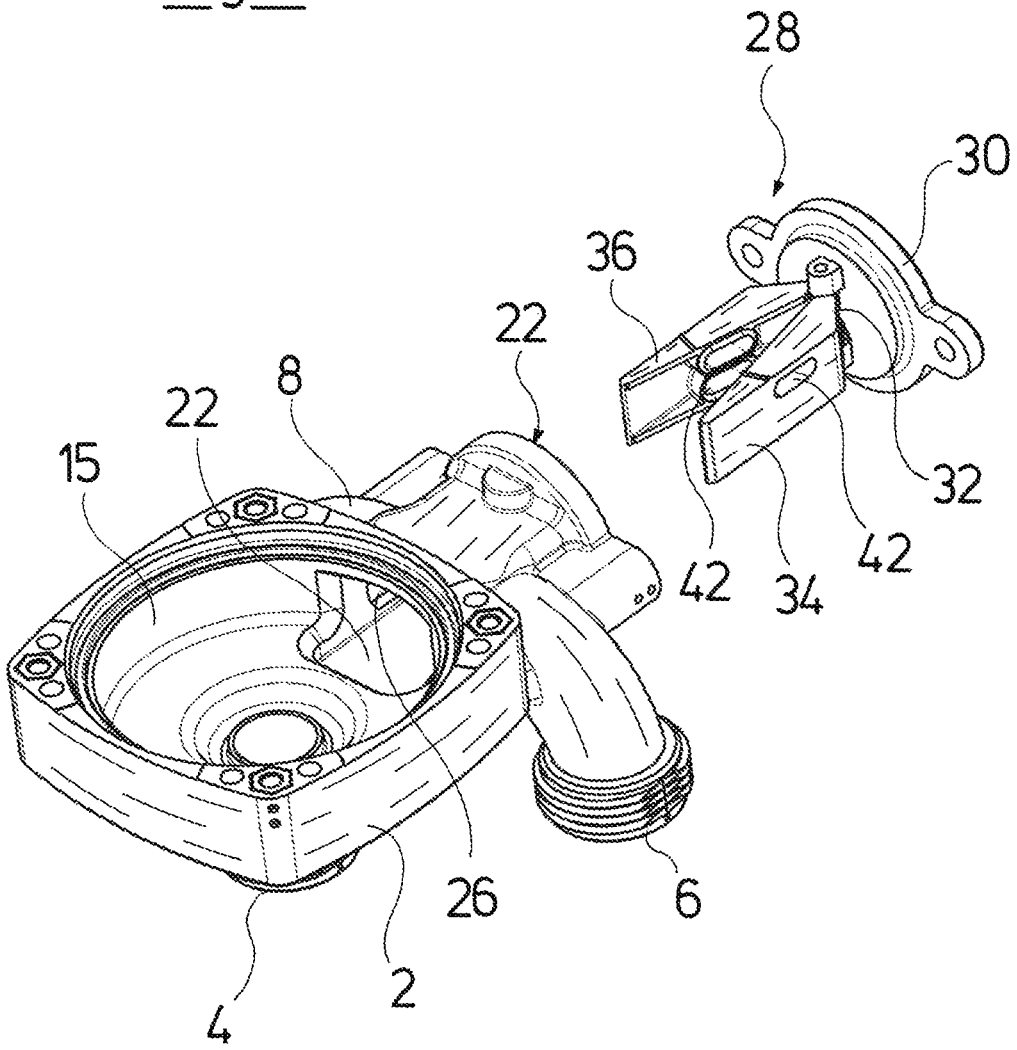
FIG. 3 is a perspective plan view of the pump casing, with a removed valve insert.
Figure 4:
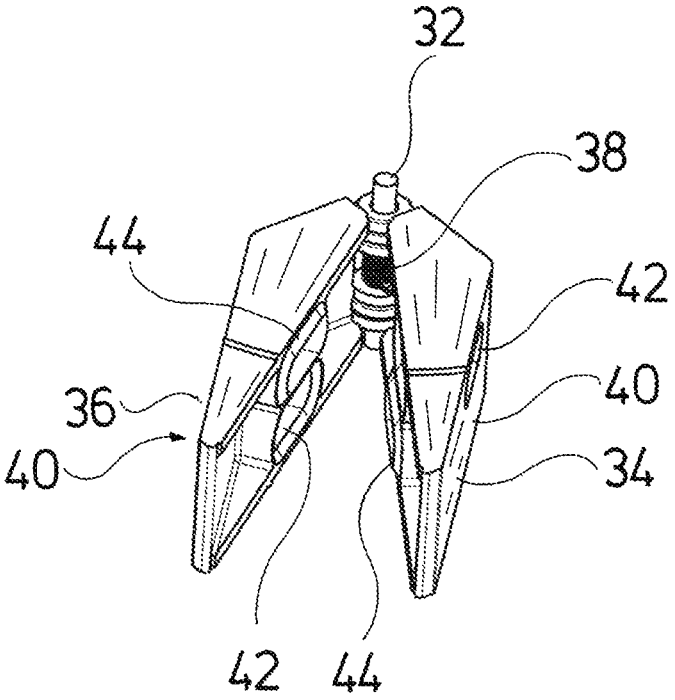
FIG. 4 is a perspective view of the arrangement of the valve elements.
Figure 5:
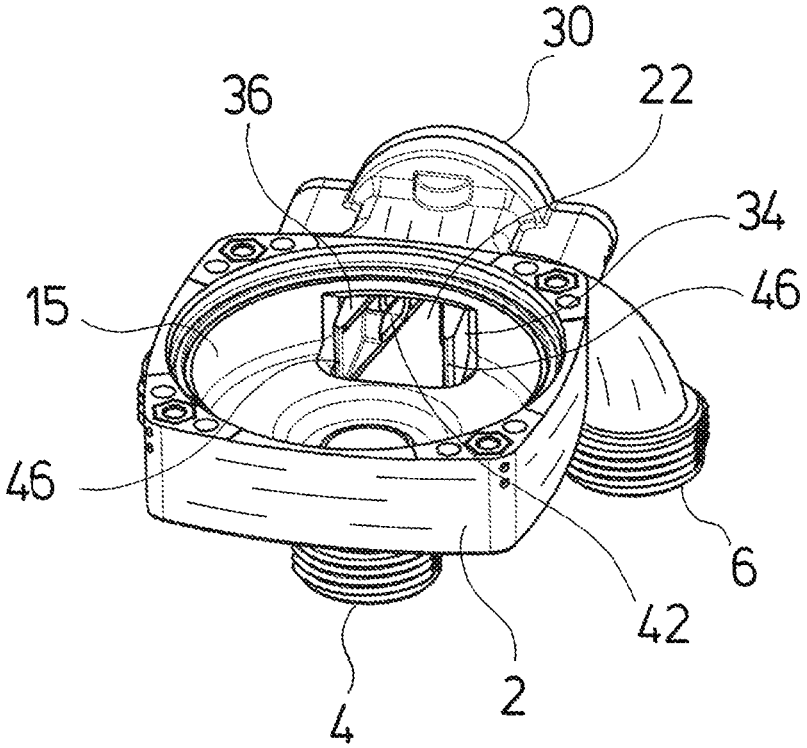
FIG. 5 is a perspective view of the open pump casing, wherein the valve elements are located in a valve element idle position.

FIG. 3 shows a valve insert 28 in the assembled condition before the insertion into the receiving opening 22 of the pump casing 2. The first and the second valve element 34, 36 are rotated by 180 to one another, and are arranged away from one another on the pivot 32, so that their outer surfaces 40 which are away from one another form sealing surfaces coming into sealing contact on the outer periphery of the exits 24 and 26 which forms a valve seat in each case, for the closure of these exits. Elastic sealing elements can be arranged on the outer periphery of the exits 24, 26 or on the sealing surfaces 40 for this. The flap-like valve elements 34 and 36 are configured such that an opening 42 extending transversely to the sealing surface 40, through the valve element 34, 36, is formed in the sealing surface 40 in each case. The opening 42 seen in the direction of the pivot axis 32 is arranged out-of-centre in the valve element 34, 36. The opening 42 is thereby arranged in one half in the sealing surface 40, seen in the direction of the pivot 32. The opening 42 in the first valve element 34 thus lies offset to the opening 42 in the second valve element 36, since the two valve elements 34 and 36 which are configured identically are arranged in a manner rotated to one another by 180. The opening 42 in the first valve element 34, in FIG. 4 lies in the upper half, whereas the opening 42 in the second valve element 36 lies in the lower half. The effect of this is that the openings 42 in the two valve elements 34 and 36 are not aligned or flush with one another when the two valve elements 34 and 36 come to bear on one another. In contrast, the valve elements 34 and 36 at their side which is away from the sealing surface 40, next to the opening 42 comprise an engagement element 44 which with regard to its shape corresponds to the opening 42 on the same side. The engagement element 44 of the first valve element 34 thus engages into the opening 42 of the second valve element 36 when the two valve elements come to bear on one another whilst overcoming the spring force of the rotary spring 38. The opening 42 of the second valve element 36 is thus closed by the first valve element 34 and its engagement element 44. The engagement element 44 can be configured elastically in the form of a seal. In a corresponding manner, the engagement element 44 of the second valve element 36 engages into the opening 42 of the first valve element 34 for its closure.

Figure 6A:
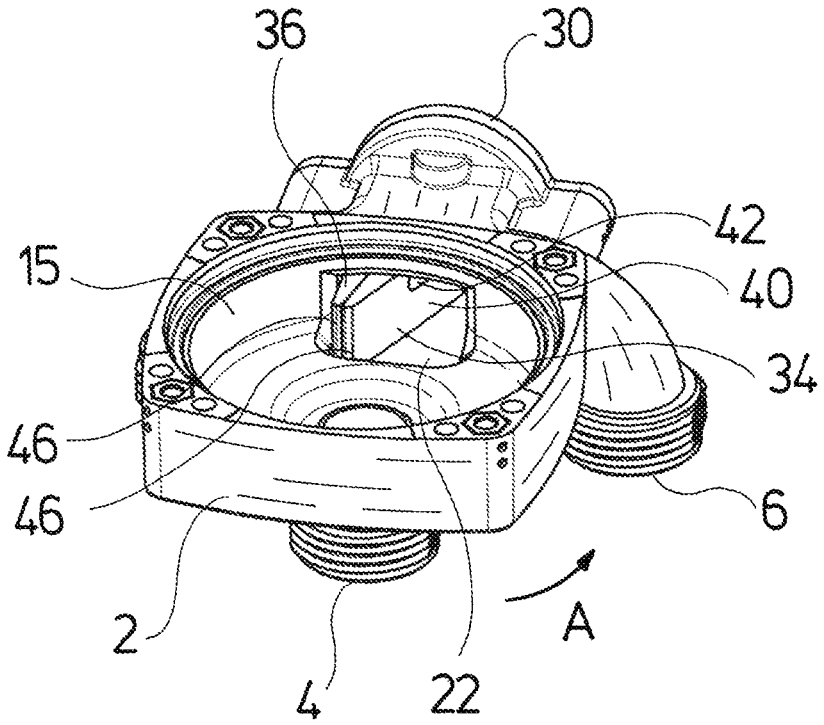
FIG. 6A is a view according to FIG. 5, in which the first valve element is located in a first valve element opened position.
Figure 6B:
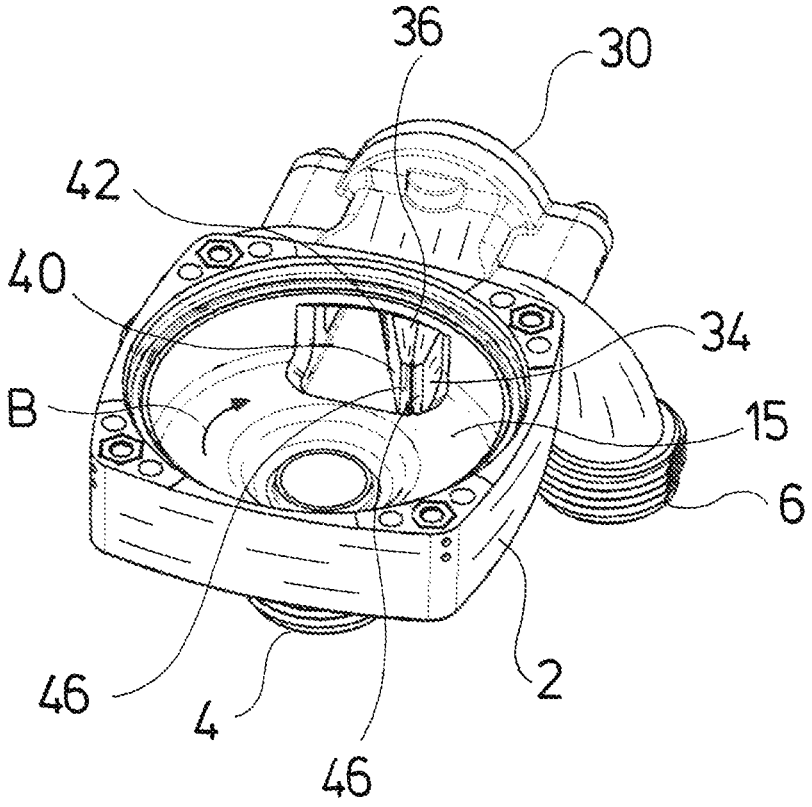
FIG. 6B is a view according to FIG. 5, in which the second valve element is located in a second valve element opened position.
Figure 7:
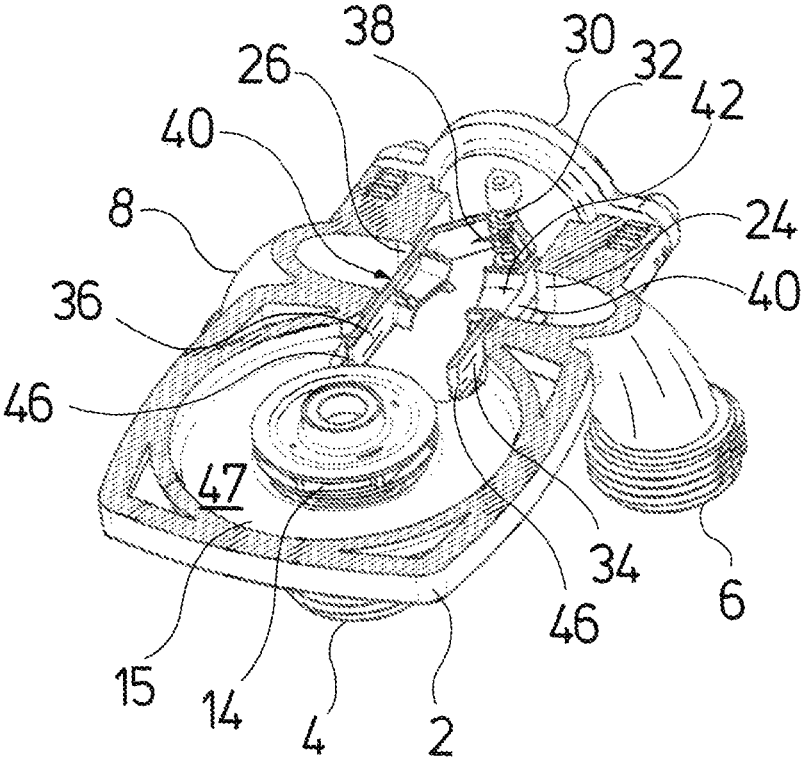
FIG. 7 is a sectioned view of the pump assembly, in which the valve elements are located in the valve element idle position.

As is to be seen in FIG. 7, the first and the second exit 24 and 26 in the receiving opening 22 lie opposite one another, wherein valve seats formed by the edge of the exits 24 and 26 are situated in planes which are parallel to one another. If the valve insert 34 is inserted into receiving opening 22, the first valve element 34 and the second valve element 36 are pressed by the rotary spring 38 functioning as a restoring element, into their idle position which represents a closed position, in which the first valve element 34 covers the first exit 24 and the second valve element 36 covers the second exit 26. The first exit and the second exit are thus essentially closed by the first valve element 34 and the second valve element 36, i.e. closed with the exception of the flow passage through the openings 42. As can be recognized in FIGS. 5, 6, 7 and 8, the valve elements 34 and 36, in a direction transverse to the pivot axis 32 are configured so long, that their ends 46 distanced to the pivot axis 32 extend into the interior 15 and thus into an annular space surrounding the impeller 14. The surfaces which are adjacent the ends 46, in the extension of the sealing surfaces 40 of the valve elements 34, 36 form engagement surfaces, upon which the flow rotating in the interior 15 acts on rotation of the impeller 14.

The control device which is arranged in the electronics housing 12 is configured such that it can activate the electrical drive motor in two different rotation directions A and B in a targeted manner. This can be effected for example via a frequency converter which subjects the coils in the stator to current in a targeted manner. The valve device in the valve insert 28 is configured such that it guides the flow into the first exit 24 and thus to the first delivery branch 6 or into the second exit 26 and thus to the second delivery branch 8, depending on the rotation direction A, B. The heating circuit of a heating for a building for example can connect to the first delivery branch 6, whereas a heat exchanger for heating service water connects to the second delivery branch 8.

Figure 8A:
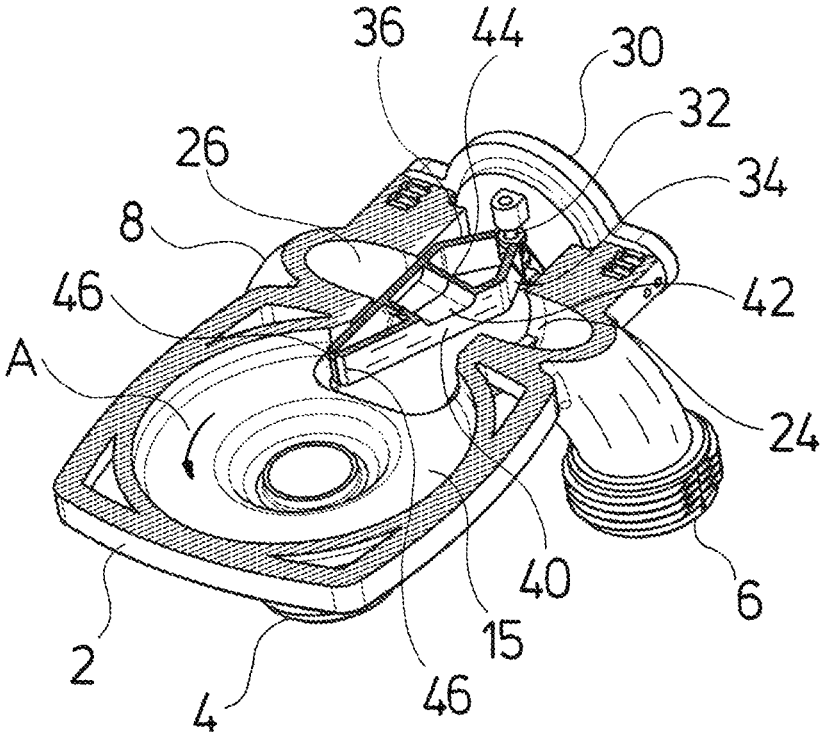
FIG. 8A is a sectioned view according to FIG. 7, wherein the first valve element is located in the first valve element opened position.

On starting operation of the pump assembly therefore, the rotation direction is first set by the control device 12, in order to set one of the two exits 24 or 26, through which the fluid is to be delivered. If now the first exit 24 with the connecting delivery branch 6 is to be used, the pump assembly is set into movement such that the impeller rotates in the first rotation direction A. The exits 24 and 26, with the exception of the flow passages through the openings 42 are essentially closed in the idle position shown in FIGS. 5 and 7. The openings 42 effect a pressure compensation between both sides of the valve elements 34 and 36, so that the valve elements 34 and 36 on starting operation of the pump assembly are not pressed against the exits 24 and 26 by the pressure forming in the interior 15. This means that the valve elements 34 and 36 are held in their position essentially merely by the rotary spring 38. A rotating flow in the peripheral region of the impeller is produced in the interior 15 of the pump casing 2, on rotation of the impeller in the direction A. The flow thereby likewise rotates in the rotation direction A and this acts upon the engagement surface of the first valve element 34. The flow therefore produces a force on the first valve element 34 and this force counteracts the spring force of the rotary spring 38 and thus moves the first valve element 34 out of the closed position into its opened position, in which the valve element 34 bears on the second valve element 36. Thereby, the first valve element 34 closes the opening 42 in the second valve element 36. The second exit 26, on which the second valve element 36 remains in contact, is now completely closed. The first exit 24 is completely opened, so that the flow flows through this exit 24 into the delivery branch 6. The pressure prevailing in the interior 15 now simultaneously acts upon the sealing surface 40 of the first valve element 34, and this first sealing element via the contact on the second valve element 36 presses this into additional sealing contact with the valve seat surrounding the second exit 26. This condition, in which the first valve element 34 is opened and thus a flow path through the first exit 24 to the delivery branch 6 is therefore opened, is represented in FIGS. 6A and 8A.

If the drive motor is formed by the control device, then the impeller 14 comes to a standstill and the flow as well as the pressure in the interior 15 disappears. The first valve element 34 is thereupon brought again into its idle position by way of the rotary spring 38, in which idle position it essentially closes the first exit 24. If the pump assembly is operated in the opposite rotation direction B, then accordingly the second valve element 36 will move into an opened position, in which it comes to bear on the first valve element 34 and thus completely closes the opening 42 in the first valve element 34, and thus the first exit 24. The second exit 26 is simultaneously opened and the flow can flow through this exit into the second delivery branch 8. This condition, in which the second valve element 36 is in its opened position, is represented in FIGS. 6B and 8B.

On starting operation of the pump assembly, one succeeds in firstly only a pressure and flow which is utilized for moving one of the valve elements 34, 36 into its opened position, being built up in the interior 15 of the pump casing 2, due to the fact that the exits 24 and 26 are essentially closed by the valve elements 34 and 36 in the idle position. In this condition, at first, essentially no flow and no pressure is built up in the systems connecting to the delivery branches 6 and 8, by which means water hammers are reduced when switching the valve elements 34. Thus a very gentle or smooth switching can be achieved. This is also encouraged by the pressure compensation via the openings 42, since only a very low switching force is thus necessary for moving the valve elements 34 and 36. The control device in the electronics housing 12 can moreover adapt the acceleration of the drive motor such that at first, on starting operation, only so much pressure and flow are built up, so as to move one of the valve elements 34, 36 into the desired opened position, and only subsequently is the motor accelerated, so that the desired final pressure or flow is built up.

Figure 8B:
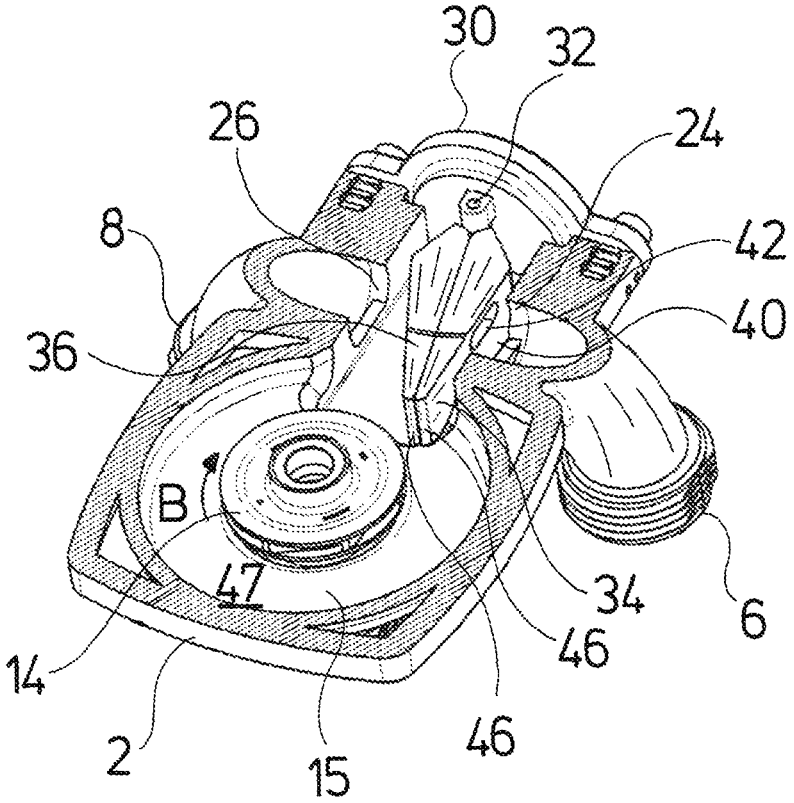
FIG. 8B is a sectioned view according to FIG. 7, wherein the second valve element is located in the second valve element opened position.

The interior 15 of the pump casing 2 is dimensioned such that it has a significantly larger diameter than the outer diameter of the impeller 14, as is represented in the FIGS. 7 and 8B. A free annular space 47 thus remains in the peripheral region of the impeller 14, in which a rotating flow can form in the periphery of the impeller 14, which then acts upon the engagement surfaces of the valve elements 34 and 36, depending on the rotation direction, in order to be able to move these into the opened position. The valve elements 34 and 36 are dimensioned such that their free ends 46, at every angular position during the pivot movement about the pivot axis 32, are distanced to the outer periphery of the impeller 34 such that the valve elements 34 and 36 do not collide with the impeller 14. Further preferably, the distance between the ends 46 and the outer periphery of the impeller 14 is selected such that a free space always remains, through which the annular or rotating flow can run in the peripheral region of the impeller 14. The annular space 47 additionally leads to an overall improved efficiency, particularly if the impeller 14 comprises arcuate blades.

The receiving opening 22 is configured such that no undercuts are formed in a direction radially to the rotation axis X of the drive motor. The receiving opening 22 can thus be formed by a core, which can be pulled out to the outside in the radial direction after the molding of the pump casing 2. This permits a more simple manufacture of the receiving space 22.

Figure 9:
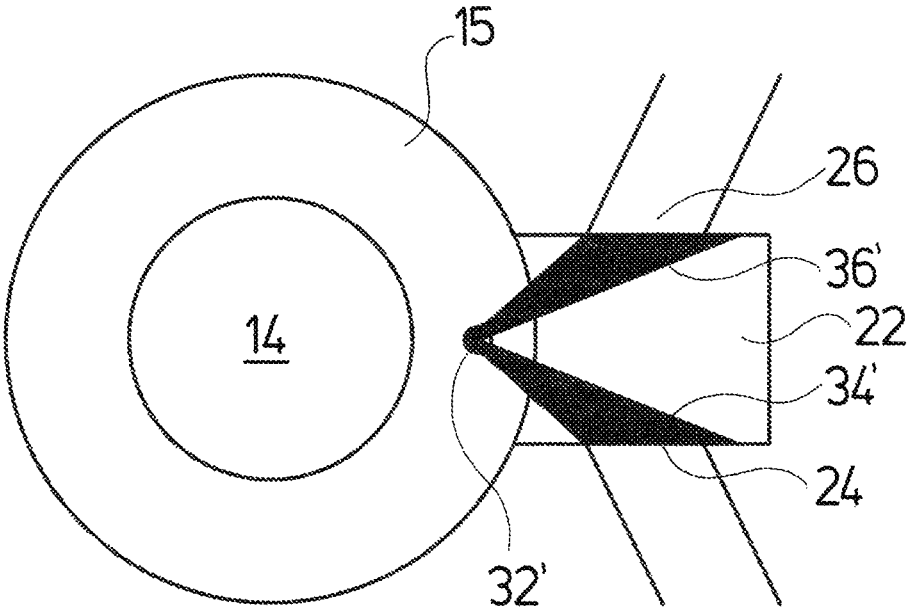
FIG. 9 is a schematic view of an arrangement of the valve elements in the pump casing, according to a second embodiment of the invention, wherein the valve elements are located in the closed position.
Figure 10:
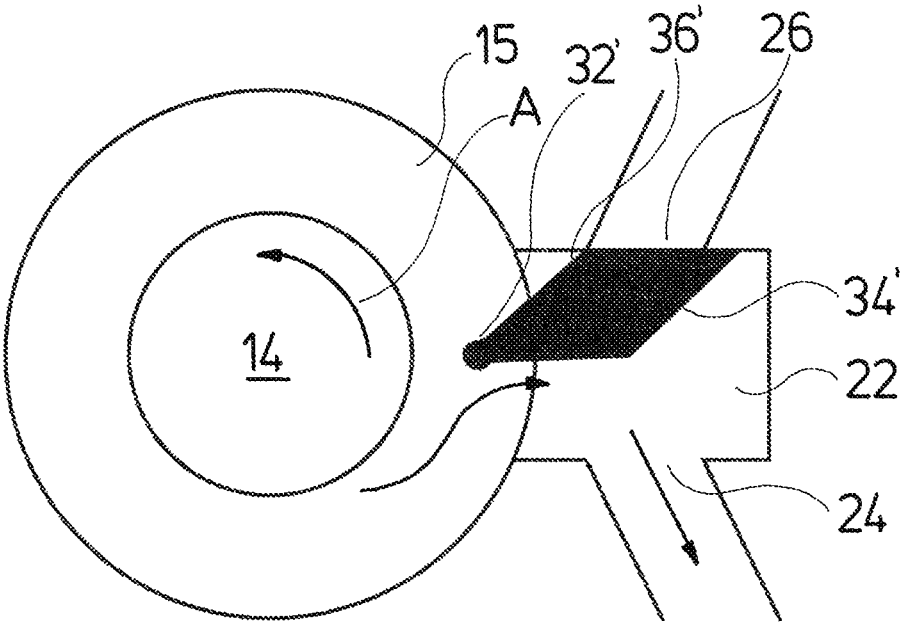
FIG. 10 is a schematic view of an arrangement according to FIG. 9, in which one of the valve elements is located in the opened position.

With the previously described embodiment example, the valve elements 34 and 36 are articulated on the pivot such that the pivot or pivot axis 32 with respect to the rotation axis X of the impeller is arranged on the radially outer end of the valve elements 34, 36, which is to say the pivot or pivot axis 32 is distanced maximally from the impeller or the rotation axis X in the radial direction. As is schematically represented in FIGS. 9 and 10, the pivot axis 32' however could also be situated on the radially inner end of the valve elements 34' and 36'. With this arrangement too, a flow would be produced in the same direction for example in the rotation direction A of the impeller 14, and this flow acts upon the first valve element 34' such that this pivots about the pivot axis 32' such that the first exit 24 is released and simultaneously the first valve element 34' comes to bear on the second valve element 36'. The flow is therefore guided into the first exit 24, whilst the second exit 26 remains closed. The remaining design of the valve elements 34' and 36' can thereby correspond to the design described above. In particular, openings 42 can likewise be provided.

Figure 11:
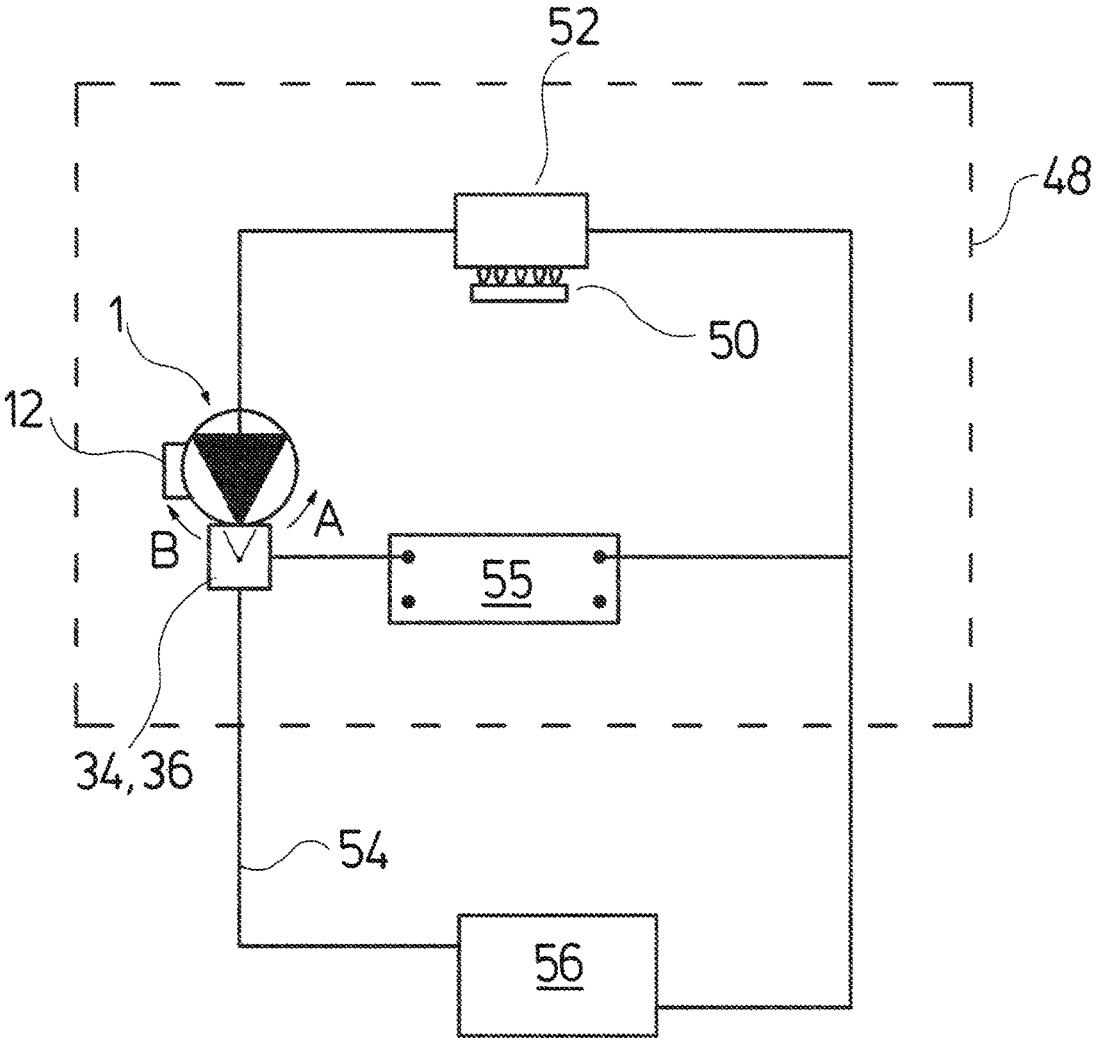
FIG. 11 is a block diagram of a heating facility with a pump assembly according to the invention.

As described above, the circulation pump assembly according to the invention is preferably applied into a heating facility, in particular into a gas heater, which is likewise the subject matter of the invention. Such a heating facility with a gas heater 48 is represented schematically in FIG. 11. The gas heater 48 comprises a combustor 50 with a primary heat exchanger 52, via which the water is heated in the heating circuit. The water is delivered through the heating circuit via the pump assembly 1. The rotation direction of the pump assembly 1 is set via the control device 12 of this pump assembly in the described manner, by which means the valve arrangement formed by the valve elements 34, 36 is switched over. The valve arrangement serves for switching over the flow path between a heating circuit 54 which runs through a building, and a secondary heat exchanger 55 which serves for heating service water. The heating circuit 54 runs through one or more radiators 56, wherein circuits of a floor heating can also be considered as a radiator in the context of this description. The flow either runs through the secondary heat exchanger 55 or the heating circuit 54, depending on the rotation direction A, B. In the case that the impeller 14 is to comprise arcuate blades for increasing the efficiency, then the facility is preferably configured such that that rotation direction, with which the heating water is led through the heating circuit 54, is that rotation direction, for which the curvature of the impeller blades is optimized. It is therefore ensured that the pump assembly 1 operates at maximum efficiency for the most part of the operating time, since the rotation direction, with which the water is led through the secondary heat exchanger 55, as a rule is used more seldom, since the operating times for service water heating as a rule are less than the operating times for heating a building. The primary heat exchanger 52 with the combustor 50, the pump assembly 1 as well as the secondary heat exchanger 55 preferably form constituents of the gas heater 48, and the pump assembly 1 and the secondary heat exchanger 55 are preferably integrated into a hydraulic construction unit which is to say into a hydraulic block.

While specific embodiments of the invention have been shown and described in detail to illustrate the application of the principles of the invention, it will be understood that the invention may be embodied otherwise without departing from such principles.

What is claimed is:

1. A pump assembly comprising:

a pump casing;

an impeller rotatably arranged in the pump casing;

an electrical drive motor connected to the impeller for selectively driving the impeller in two rotation directions; and a valve arrangement arranged in the pump casing and configured to switch a flow path downstream of the impeller between two exits formed in the pump casing, depending on a rotation direction of the impeller, the valve arrangement comprising a first movable valve element at a first of the two exits and a second movable valve element at a second of the two exits, wherein the valve elements in an idle position are each located in a closed position, in which the first valve element at least partly closes the first exit, and the second valve element at least partly closes the second exit, and the first valve element is movable into an opened position by way of a flow caused by the impeller in a first rotation direction, and the second valve element is movable into an opened position by way of a flow caused by the impeller in a second rotation direction, wherein the first valve element and the second valve element each comprise an opening, which permits a flow passage into the respective associated first exit and second exit even in a closed position of the respective the first valve element and the second valve element.

2. A pump assembly according to claim 1, wherein the first valve element and the second valve element are movable independently of one another.

3. A pump assembly according to claim 1, wherein the first valve element and the second valve element are each configured as a flap which is pivotable about a pivot axis, between the opened position and the closed position.

4. A pump assembly according to claim 3, wherein the first valve element and the second valve element are pivotable about the same pivot axis.

5. A pump assembly according to claim 1, wherein the first valve element and the second valve element are arranged to be in contact with one another when one of the valve elements is located in the opened position.

6. A pump assembly according to claim 1, wherein the opening in the first valve element and the opening in the second valve element are arranged offset to one another such that the opening in the first valve element is closed by the second valve element and the opening in the second valve element is closed by the first valve element, when the first valve element and the second valve element are in contact with one another.

7. A pump assembly according to claim 1, wherein the valve arrangement further comprises at least one restoring element and the first valve element and the second valve elements are subjected to force by way of the at least one restoring element, such that given a standstill of the impeller the first valve element and the second valve elements are each held in the closed position, and the first valve element and the second valve element are subjected to force by the at least one common restoring element arranged between the valve elements.

8. A pump assembly according to claim 1, wherein the first valve element and the second valve elements are each configured elastically or rigidly.

9. A pump assembly according to claim 1, wherein:

the first valve element and the second valve elements each have an elastic seal arranged thereon; or a valve seat is provided lying opposite the first valve element and a valve seat is provided lying opposite the second valve element; or the first valve element and the second valve elements each have an elastic seal arranged thereon and a valve seat is provided lying opposite the first valve element and a valve seat is provided lying opposite the second valve element.

10. A pump assembly according to claim 1, wherein the pump casing comprises a receiving opening situated between the two exits and which is open to an interior of the pump casing and into which the two valve elements are inserted from an outer side of the pump casing, wherein the two valve elements are preferably mounted in a valve insert which is inserted into the receiving opening.

11. A pump assembly according to claim 1, wherein the two exits comprise valve seats which face an interior of the pump casing and which lie opposite one another, wherein the valve seats are aligned essentially parallel to one another.

12. A pump assembly according to claim 11, wherein the valve elements each comprise a sealing surface which is provided for contact on one of the valve seats and which extends angled to a radius with respect to a pivot axis of the respective valve element.

13. A pump assembly according to claim 1, wherein the pump assembly is configured as a heating facility circulation pump assembly with the electrical drive motor comprising a wet-running drive motor.

* * * * *